US005664731A

United States Patent [19]

Lemetyinen et al.

[11] Patent Number: 5,664,731

[45] Date of Patent: Sep. 9, 1997

[54] DECONTAMINATION VALVE FOR A JET PIPE IN A PAPER OR BOARD MACHINE

[75] Inventors: Markku Lemetyinen, Baton Rouge, La.; Markku Kyynarainen, Paimio, Finland

[73] Assignee: Valmet Corporation, Helsinki, Finland

[21] Appl. No.: 534,325

[22] Filed: Sep. 27, 1995

Related U.S. Application Data

[63] Continuation-in-part of Ser. No. 146,785, Nov. 2, 1993, abandoned.

[30] Foreign Application Priority Data

Apr. 11, 1992 [FI] Finland ..... U920661

[51] Int. Cl.[6] ..... B05B 15/02

[52] U.S. Cl. ..... 239/113; 239/116; 239/566

[58] Field of Search ..... 239/112–116, 106, 239/566, 582.1; 251/264, 274, 330, 331

[56] References Cited

U.S. PATENT DOCUMENTS

| | | | |
|---|---|---|---|
| 1,565,863 | 12/1925 | Murphy | 230/112 |
| 2,536,946 | 1/1951 | Larson | 239/116 |
| 2,631,893 | 3/1953 | Cartwright | 239/582.1 |
| 2,780,492 | 2/1957 | Stine | 239/116 |
| 2,884,203 | 4/1959 | Broughton | 239/566 X |
| 3,228,611 | 1/1966 | Russell | 239/112 X |

FOREIGN PATENT DOCUMENTS

| | | | |
|---|---|---|---|
| 1119933 | 3/1955 | France | 239/116 |
| 19964 | of 1912 | United Kingdom | 239/581.2 |
| 376023 | 7/1932 | United Kingdom | 239/581.2 |

*Primary Examiner*—Kevin Weldon

*Attorney, Agent, or Firm*—Steinberg, Raskin & Davidson, P.C.

[57] ABSTRACT

A decontamination valve for a jet pipe in a paper or board machine, including a disc valve having a closed position and an open position. The disc valve is in the closed position when the jet pipe is in operation and is in the open position when the jet pipe is being cleaned in order to remove cleaning/washing water used in the cleaning process. The disc valve is arranged to close in the same direction in which pressure effective in the jet pipe attempts to shift the valve.

19 Claims, 4 Drawing Sheets

DECONTAMINATION VALVE FOR A JET PIPE IN A PAPER OR BOARD MACHINE

This application is a continuation-in-part of U.S. patent application Ser. No. 08/146,785 filed Nov. 2, 1993, now abandoned.

SUMMARY OF THE INVENTION

The present invention relates to a decontamination valve for a jet pipe in a paper or board machine, comprising a disc valve which is closed when the jet pipe is in operation and open when the jet pipe is being cleaned in order to remove the cleaning/washing water.

BACKGROUND OF THE INVENTION

In the cleaning of the fabrics in a paper or board machine, such as the wires and/or felts, jet pipes are used and extend across the entire width of the fabric in the transverse direction. These jet pipes include a series of nozzle holes through which high-pressure water jets are applied usually to the outer face of the fabrics to clean the fabric. The pressure of the washing water is sufficiently high to perform the desired cleaning operation, however, is normally less than about 35 bar.

Jet pipes are usually placed in connection with the return runs of the wires or felts in a paper machine. In the wire part of a paper or board machine, jet pipes are also used for cleaning of, e.g., the breast roll, the drive roll, and the wire-return rolls. With regard to wire-return rolls, jet pipes may also be used in connection with various doctor constructions. Further, jet pipes may be used, e.g., in connection with suction boxes and with devices for cleaning drying wires. Jet pipes are also used for internal cleaning of former rolls and suction rolls.

It is inevitable that on the inside faces and in the nozzle openings of the jet pipes, dirt or other impurities is deposited and must be cleaned from time to time, e.g., by means of brushes or equivalent cleansing means to prevent blockage of the jet pipe and to guarantee its reliable operation. The jet pipes are usually provided with a decontamination valve through which the water for cleaning/washing of the jet pipe is removed so that the removed contaminants do not enter into the object proper to be cleansed, i.e., the wire, felt or roll. For example, when paper is manufactured in three shifts, the jet pipes are cleaned, e.g., once during each shift.

In the prior art, a disc valve is used as the decontamination valve for a jet pipe. The disc valve closes the opening through which the used washing water is removed for the duration of the cleaning operation proper and use of the jet pipe. The valve is opened when the jet pipe itself is cleaned so that the cleaning/washing water is removed through the washing opening into a wash water duct. In a typical conventional arrangement, the disc valves are arranged in connection with the jet pipes so that they are closed against the pressure effective in the jet pipe. As a result, it is disadvantageous that it is difficult to close the valve and the valve may leak or, to be tight, at least require tightening to an extreme closing position.

OBJECTS AND SUMMARY OF THE INVENTION

An object of the present invention is to provide a decontamination valve for a jet pipe that is free from the drawbacks of the prior art decontamination valves mentioned above.

It is another object of the present invention to provide a disc valve as a decontamination valve arranged so that the pressure effective in the jet pipe during use serves to assist in the closure of the disc valve.

It is yet another object of the present invention to provide a new and improved disc valve for use as a decontamination valve which is easy to manufacture and use.

It is another object of the present invention to provide a new and improved method for maintaining a tight seal between a jet pipe and a decontamination valve arranged at an end of the jet pipe.

It is still another object of the present invention to provide a decontamination valve in which the opening and closing motion of the decontamination valve results in the cleaning of nozzles in the jet pipe and the inner face thereof.

In view of achieving the objects stated above and others, the decontamination valve in accordance with the present invention for a jet pipe includes a disc valve arranged to be closed in the same direction in which the pressure effective in the jet pipe attempts to shift the valve.

The valve in accordance with the present invention is closed in the same direction in which the pressure present in the jet pipe attempts to shift it, whereby the valve is tight even if it had not been tightened to an extreme closing position. In this manner, a reliable sealing is achieved and any leakage of fluid is avoided. Thus, a more effective jet spraying is achieved than in the prior art devices. Also, there is an economization in the quantity of water to be used.

Another advantage of the present invention over the prior art devices is that a plastic seal is not used in the disc valve. Therefore, there is no possibility that the plastic seal will be worn equally and extensively as in the prior art solutions in which the plastic seal in the valve is worn because of the constant water flow resulting from leakage.

Also, the decontamination valve in accordance with the present invention is easy to open and particularly easy to close.

In the present invention, a valve housing is attached to an end of the jet pipe and has an opening therein. The disc valve cooperates with the opening of the valve housing to define an open passage between an interior of the jet pipe and the opening of the valve housing when the disc valve is in the open position. The valve housing includes a wash water chamber adjacent to the opening which is preferably conical. The conicity of the opening is arranged so that a larger cross-sectional opening in the valve housing is situated on a side facing the jet pipe and a smaller cross-sectional opening is situated on a side facing an interior of the valve housing, i.e., the wash water chamber.

A shaft passes through the valve housing and is connected to the disc valve. The shaft is rotated in a first direction to cause the disc valve to separate, e.g., by rotation, from the opening of the valve housing and in a second direction to cause the disc valve to close the opening of the valve housing. The valve housing also includes a threading arranged to cooperate with the shaft, whereby the valve housing moves along the threading when the shaft is rotated to cause the disc valve to move relative to the opening of the valve housing, e.g., rotatively. The disc valve includes a seal portion shaped to correspond to the conical opening of the valve housing. In this manner, the pressure effective in the jet pipe pushes the disc valve and the seal portion against the conical opening of the valve housing during operation of the jet pipe to thereby provide a tight seal for the disc valve.

In the method in accordance with the present invention, a tight seal is advantageously maintained between the jet pipe and the decontamination valve arranged at an end of the jet pipe, in which the pressurized flow of fluid is passed during use of the jet pipe to clean a press roll, a press felt, a drying wire or a press nip. The decontamination valve is provided with a valve housing having an aperture therein to facilitate the removal of water from the jet pipe. A disc valve is moved in a first direction into contact with the valve housing to close the aperture of the valve housing. The pressurized flow of fluid present in the jet pipe during its use applies a force in the first direction against the disc valve to tightly seal the disc valve against the valve housing in the first direction. In a preferred embodiment, a rotatable shaft is connected to the disc valve and passed through a threading in the valve housing. The shaft is rotated to cause the disc valve to move or rotate relative to the aperture of the valve housing.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1A:
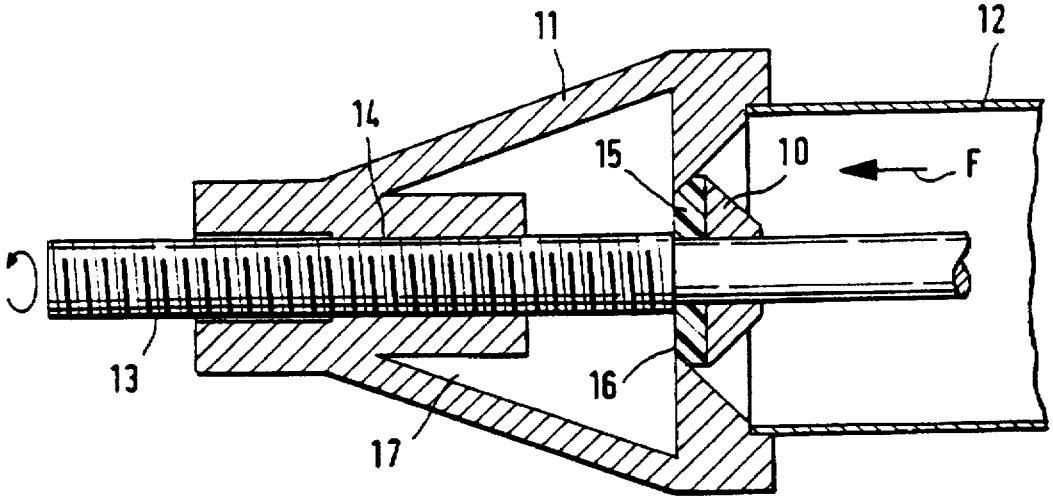
FIG. 1A shows a decontamination valve in accordance with the present invention for a jet pipe in the closed position.
Figure 1B:
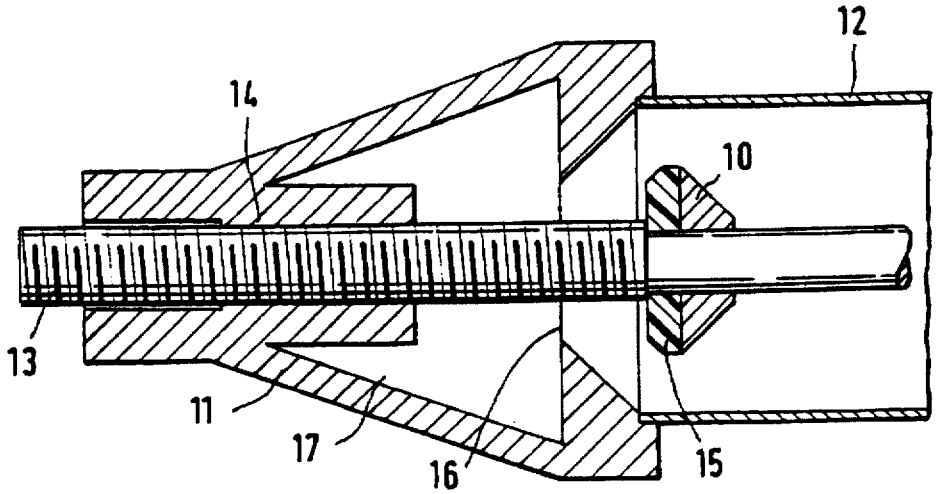
FIG. 1B shows a decontamination valve in accordance with the present invention for a jet pipe in the open position.

Referring to the accompanying drawings wherein like reference numerals refer to the same or similar elements, FIG. 1A shows a jet pipe 12 and a decontamination valve placed at one end of the jet pipe 12, usually the end placed next to the tending side of the paper or board machine. In the decontamination valve, a disc valve 10 is movable between a closed position as shown in FIG. 1A and an open position as shown in FIG. 1B. In the closed position, the disc valve 10 closes an opening 16, by engaging with inner walls that define the opening 16, that passes out of the jet pipe into a wash-water chamber 17. The level of the pressure effective in the jet pipe 12 is about 35 bar or less, and the force produced by the pressure is denoted in the figure schematically with arrow F. The pressure is the result of the introduction of pressurized fluid, e.g., water, into the jet pipe so that pressurized jets are applied to the wire, felt or roll being cleaned.

A shaft 13 is connected to a valve housing 11 of the decontamination valve. As shown in FIG. 1A, the shaft 13 extends through the housing 11 to the disc valve 10 and continues through into the jet pipe 12. When the shaft 13 is rotated at its end by, e.g., rotation means (not shown), the disc valve 10 rotates into a closed position in the same direction as the pressure F effective in the jet pipe 12 attempts to shift it. To achieve this closure effect, a seal portion 15 of the disc valve 10 closes the opening 16 between the wash water chamber 17 and the jet pipe 12. The wash water chamber 17 has been formed into the valve housing 11. A threading 14 is formed in the valve housing 11 of the decontamination valve. The threading 14 cooperates with a corresponding threading on a portion of the shaft 13 such that upon rotation of the shaft 13, the disc valve 10 is displaced by rotation and moves in a direction either toward or away from the opening 16 depending on the direction of rotation of the shaft 13.

Figure 3:
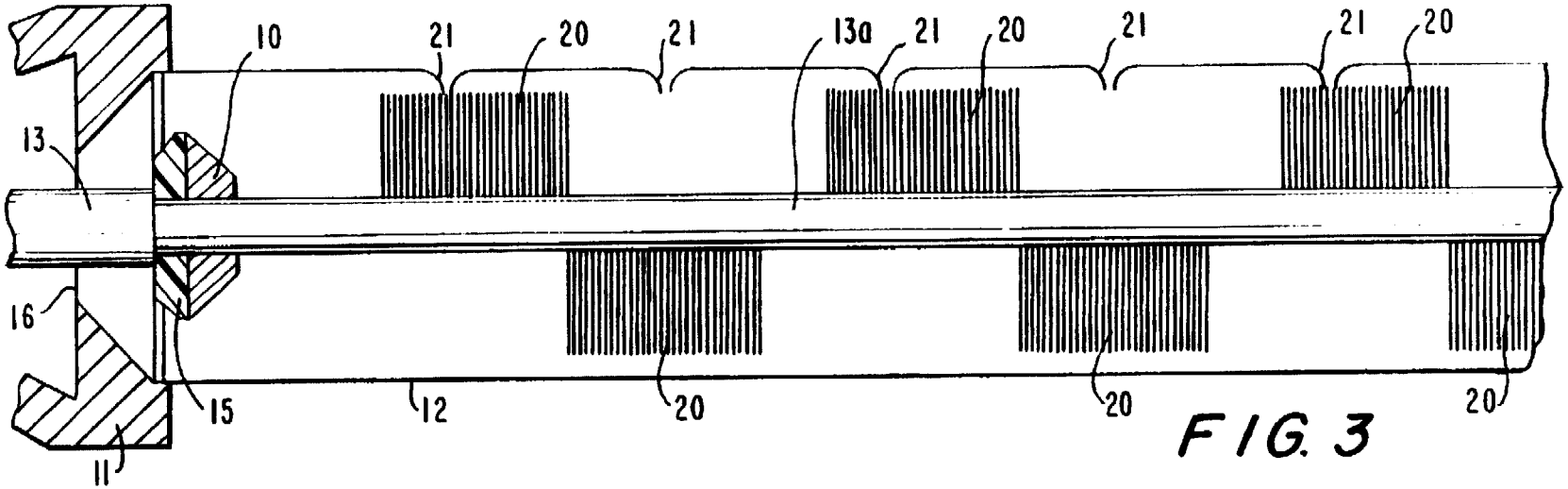
FIG. 3 shows a jet pipe in which the decontamination valve in accordance with the present invention is arranged.

FIG. 1B shows the valve in accordance with the present invention in the open position. In this position, the interior and the nozzle openings (as shown in FIG. 3) of the jet pipe 12 are cleaned and the wash water is removed through the opening 16 into the wash-water chamber 17. From the chamber 1, the wash water is removed further through a wash opening (not shown in the figure).

In FIGS. 1A and 1B, corresponding parts of the jet pipe 12 are denoted with the same reference numerals.

As shown in FIGS. 1A and 1B, the opening 16 between the wash-water chamber 17 and the jet pipe 12 is conical, whereby the seal portion 15 of the disc valve 10 rests against the faces of the cone, thereby improving the sealing. The conicity of the opening 16 is arranged so that the larger cross-sectional opening is on the side facing toward the jet pipe 12 and the smaller cross-sectional opening is on the side facing the wash water chamber 17. When the shaft 13 is rotated by its end, the shaft 13 moves in the threading 14, whereby the disc valve 10 is displaced and opens the opening 16. In a corresponding manner, when the shaft 13 is rotated in the opposite direction, the shaft 13 slides along the threading 14 so that the disc valve 10 closes the opening 16.

The valve housing 11 of the decontamination valve is made preferably as a one piece structure, e.g., by producing a cast blank. The threading 14 and the conical sealing faces in the opening 16 between the wash-water chamber 17 and the jet pipe 12 are prepared, e.g., by machining, in the cast blank. Thus, the decontamination valve in accordance with the invention is also simple in respect of its manufacturing technology and assembly, being, consequently, economical.

As shown in FIG. 3, the jet pipe 12 has a plurality of nozzle holes 21 through which water jets are applied against a paper felt or paper roll by pressure induced in the jet pipe 12, as known in the prior art. The jet pipe 12 has a decontamination valve in accordance with the present invention arranged at one end of the jet pipe. As described above, the decontamination valve comprises a valve housing 11 having an opening 16, a disc valve 10 arranged in the opening 16, and means for closing the opening 16. The means are arranged to close the opening by moving the disc valve 10 along in one direction into contact with inner walls of the valve housing 11 which define the opening 16. The closure means may be, e.g., the rotatable shaft operating in connection with the threading on the decontamination valve. Thus, the disc valve 10 is pushed against the opening 16 of the valve housing 11 by the pressure induced in the jet pipe during operation of the jet pipe in the same direction as the disc valve is moved to close the opening.

Figure 3A:
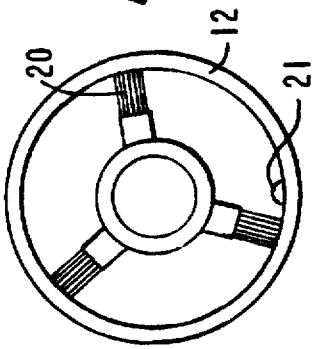
FIG. 3A shows a cross-sectional view of the jet pipe.

The shaft 13 has an elongated section 13*a* extending substantially across the entire length of the jet pipe 12. Brushes 20 are arranged only at specific locations along the shaft 13 in the longitudinal direction and in a specific spacing pattern. More particularly, the brushes 20 are arranged in a repeating pattern at three circumferential locations on shaft section 13*a* so that when the disc valve 10 closes the opening 16, the brushes 20 do not interfere with the operation of the jet pipe 12, i.e., pressurized water has an unobstructed flow through the nozzles 21 (see FIG. 3A). However, dirt and other impurities eventually clog the nozzles 21 and thus necessitate cleaning thereof.

The cleaning operation of the nozzles 21 is as follows. When the disc valve 10 is rotated by rotation of shaft 13 within the threading 14 of the valve housing 11, i.e., to open the same, the brushes 20 inside the jet pipe 12 also rotate and at the same time move slightly, about 20 mm, in the direction of the longitudinal axis of the shaft 13. The brushes 20 are arranged in discrete sections each having a length of about 300 mm. When the brushes 20 rotate, the brushes 20 move from the position in which flow through the nozzles 21 is unobstructed (FIG. 3A) into engagement with the nozzles 21 to thereby clean the hole in the nozzle 21 as well as the inner face of the pipe 12. Since the structure of the nozzles 21 is cup-shaped, i.e., the middle part of the nozzles 21 is on the inside of the inner face of the pipe 12, the brushes 20 extend to the nozzle hole as shown in FIG. 3 and clean the hole of dirt and other impurities. Thus, the rotation of the shaft 13 to open the disc valve 10 also provides for the cleaning of the nozzles 21 in a single movement. When the disc valve is then moved from its furthest open position back to its closed position, again the rotation of the shaft 13 about threading 14 causes rotation of the brushes 20 to clean the nozzles 21.

FIGS. 2A–2G show different position in which a jet pipe 12 can be used in a paper or board machine wherein the jet pipe 12 is equipped with the decontamination valve in accordance with the present invention.

Figure 2A:
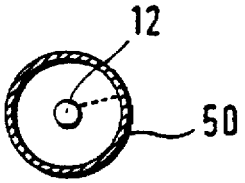
FIGS. 2A, 2B, 2C, 2D, 2E, 2F and 2G illustrate different applications of the jet pipe in accordance with the invention in paper machines.

FIG. 2A shows an embodiment in which a jet pipe 12 with its decontamination valve is applied to the cleaning of the inside of a former roll 50.

Figure 2B:
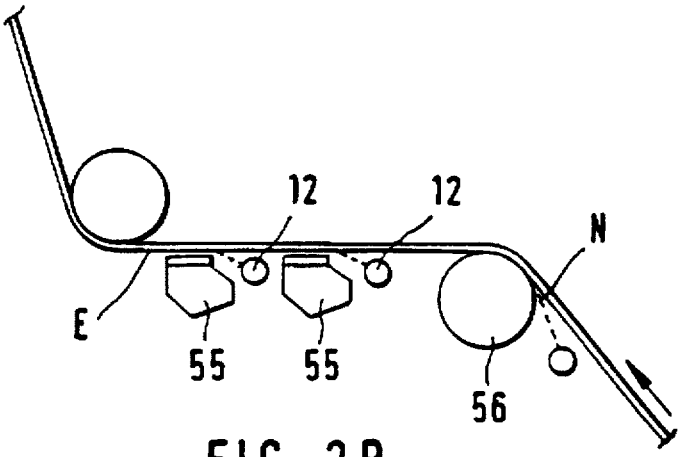

FIG. 2B shows an embodiment in which jet pipes 12 are arranged in connection with suction boxes 55 to clean a wire F and a nip N formed by the wire F and a roll 56.

Figure 2C:
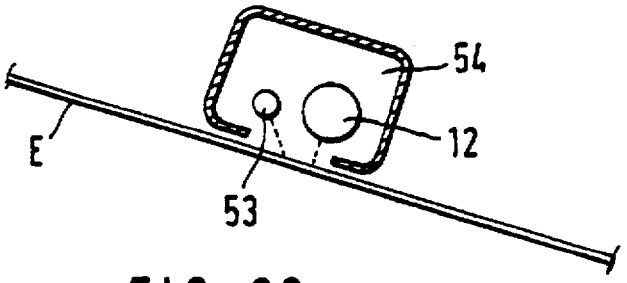

In FIG. 2C, an embodiment is shown in which a jet pipe 12 is used in combination with an air jet 53 in a device 54 for cleaning of a drying wire F.

Figure 2D:
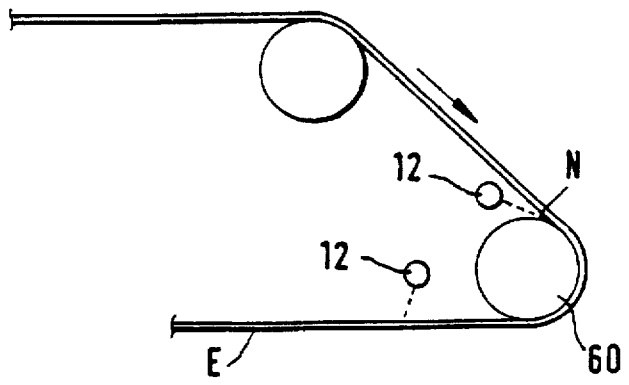

FIG. 2D shows an embodiment in which jet pipes 12 are used for cleaning the inside of a Fourdrinier forming wire loop F. One jet pipe 12 is arranged to clean a nip N before the drive roll 60, and another jet pipe 12 is arranged to clean the inside face of the wire F.

Figure 2E:
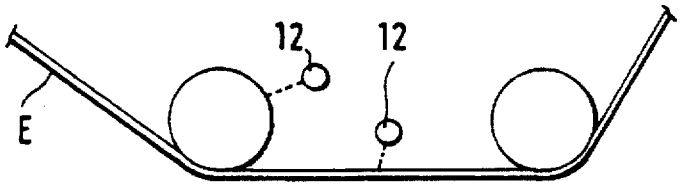
Figure 2F:
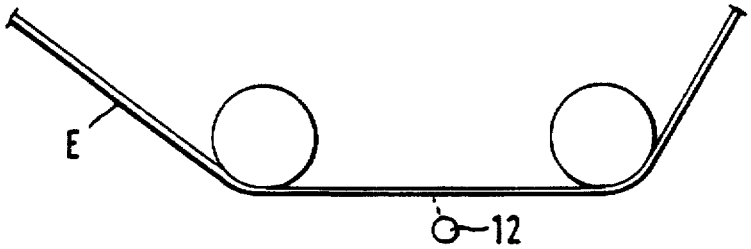

FIG. 2E shows an embodiment in which jet pipes 12 are arranged inside a wire loop F, and FIG. 2F an embodiment in which a jet pipe 12 is arranged outside the wire loop F.

Figure 2G:
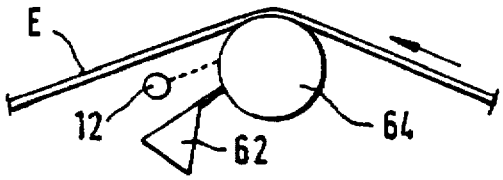

FIG. 2G shows an embodiment in which a jet pipe 12 is arranged in connection with a doctor 62 for cleaning a roll 64.

The examples provided above are not meant to be exclusive. Many other variations of the present invention would be obvious to those skilled in the art, and are contemplated to be within the scope of the appended claims.

What is claimed is:

1. In a jet pipe in a paper or board machine having a decontamination valve which has an open position when the jet pipe is cleaned to facilitate the removal of water used to clean the jet pipe and a closed position during operation of the jet pipe, the jet pipe including brushes arranged therein for cleaning an inner face of the jet pipe and nozzles in the jet pipe, a pressurized flow of fluid being passed through the jet pipe during operation of the jet pipe and applying a force in a first direction against said valve, the improvement comprising said decontamination valve comprising a disc valve operable between a closed position and an open position, and means for moving said disc valve in the first direction into the closed position such that the direction of closure of said disc valve is substantially the same as the direction in which the pressurized flow of fluid applies a force against said disc valve, said disc valve moving means constitute means for rotating the brushes to thereby clean the inner faces of the jet pipe and the nozzles in the jet pipe.

2. The decontamination valve of claim 1, wherein said disc valve further comprises a valve housing attached to an end of the jet pipe and having inner walls defining an opening, said disc valve being arranged in said opening such that water is removed from the jet pipe through said opening when said disc valve is in the open position.

3. The decontamination valve of claim 2, wherein said valve housing includes a wash water chamber adjacent to said opening.

4. The decontamination valve of claim 2, wherein said opening of said valve housing is conical.

5. The decontamination valve of claim 4, wherein said opening of said valve housing is arranged so that a larger cross-sectional opening in said valve housing is situated on a side of said valve housing facing the jet pipe and a smaller cross-sectional opening in said valve housing is situated on a side facing an interior of said valve housing.

6. The decontamination valve of claim 2, wherein said disc valve moving means comprise a shaft passing through said valve housing and connected to said disc valve, said shaft being rotated in a first direction to cause said disc valve to separate from said opening of said valve housing and in a second direction to cause said disc valve to contact said inner walls of said valve housing and close said opening of said valve housing.

7. The decontamination valve of claim 6, wherein said valve housing comprises a threading arranged to cooperate with said shaft, said valve housing moving along said threading when said shaft is rotated to cause said disc valve to move relative to said opening of said valve housing.

8. The decontamination valve of claim 4, wherein said disc valve comprises a seal portion having a shape corresponding to the conical opening of said valve housing.

9. The decontamination valve of claim 8, wherein the pressurized flow of fluid in the jet pipe pushes said disc valve and said seal portion against said opening of said valve housing during operation of the jet pipe to thereby provide a tight seal of said disc valve.

10. The decontamination valve of claim 6, wherein said shaft extends through said valve housing and substantially across the entire length of the jet pipe, the brushes arranged on a portion of said shaft situated within the jet pipe such that when said disc valve is in said closed position, said brushes do not obstruct said nozzles.

11. The decontamination valve of claim 2, wherein said disc valve moving means constitute means for rotating said disc valve relative to said valve housing.

12. In a jet pipe in a paper or board machine including a decontamination valve arranged at an end of the jet pipe, a shaft passing through said valve and an interior of the jet pipe, and brushes arranged on said shaft in an interior of the jet pipe for cleaning inner faces of the jet pipe and nozzles in the jet pipe, a pressurized flow of fluid being passed through the jet pipe during operation thereof and applying a force in a first direction against said decontamination valve, the improvement comprising said valve housing having inner walls defining an opening and a wash water chamber adjacent to said opening, said decontamination valve comprising a disc valve arranged in said opening of said valve housing to contact said inner walls, said disc valve being mounted on said shaft, and said shaft being rotated to cause said disc valve to move in a second direction and separate from said inner walls when the jet pipe is cleaned to facilitate the removal of water used to clean the jet pipe, and said shaft being rotated to cause said disc valve to move in the first direction to contact said inner walls and close said opening of said valve housing such that said disc valve is in a closed position during operation of the jet pipe, said valve housing comprising a threading arranged to cooperate with said shaft such that rotation of said shaft relative to said valve housing causes said disc valve connected to said shaft to move relative to said opening of said valve housing and rotation of said brushes to clean the inner faces of the jet pipe and the nozzles in the jet pipe.

13. The decontamination valve of claim 12, wherein said opening of said valve housing is conical.

14. The decontamination valve of claim 13, wherein said opening of said valve housing is arranged so that a larger cross-sectional opening in said valve housing is situated on a side of said valve housing facing the jet pipe and a smaller cross-sectional opening in said valve housing is situated on a side facing an interior of said valve housing.

15. The decontamination valve of claim 14, wherein said disc valve comprises a seal portion having a shape corresponding to the conical opening of said valve housing.

16. The decontamination valve of claim 12, wherein the movement of said disc valve is rotation in conjunction with rotation of said shaft and relative to said valve housing.

17. In an arrangement in a paper or board machine including a jet pipe having a plurality of nozzle holes through which a pressurized flow of fluid is directed against a paper felt or paper roll during use of said jet pipe to clean the felt or roll, the jet pipe including a decontamination valve arranged at an end of the jet pipe, said decontamination valve having an open position when the jet pipe is cleaned to facilitate the removal of water used to clean the jet pipe and a closed position during operation of the jet pipe, the jet pipe including brushes arranged therein for cleaning inner faces of the jet pipe and nozzles in the jet pipe, the improvement comprising said decontamination valve comprising a valve housing having inner walls defining an opening through which water is removed from said jet pipe, a disc valve positionable in said opening to close said opening, and means for closing said opening by moving said disc valve in a first direction into contact with said inner walls such that the direction of closure of said opening of said valve housing by said disc valve is substantially the same as a direction in which the pressurized flow of fluid applies a force against said disc valve.

18. In a method for cleaning a jet pipe having a decontamination valve arranged at an end of the jet pipe, in which a pressurized flow of fluid is passed during use of the jet pipe to clean a press roll, a press felt, a drying wire or a press nip, the decontamination valve having a valve housing with an aperture therein to facilitate the removal of water from the jet pipe, the jet pipe including brushes arranged therein for cleaning inner faces of the jet pipe and nozzles in the jet pipe, the improvement comprising the steps of:

moving said disc valve in a first direction into contact with the valve housing to close the aperture of the valve housing such that the direction of closure of said disc valve is substantially the same as the direction in which a pressurized flow of fluid applies a force against said disc valve, and coupling brushes on a shaft in the jet pipe to said disc valve such that movement of said disc valve causes movement of the brushes to clean the inner faces of the jet pipe and the nozzles in the jet pipe.

19. The method of claim 18, further comprising connecting a rotatable shaft to the disc valve, and passing the shaft through a threading in the valve housing, the shaft being rotated to cause the disc valve to move relative to the aperture of the valve housing.

* * * * *